US012529371B2

(12) United States Patent
Helpertz

(10) Patent No.: US 12,529,371 B2
(45) Date of Patent: Jan. 20, 2026

(54) METHOD FOR ASCERTAINING LEAKS OF A DISPLACEMENT PUMP

(71) Applicant: Brinkmann Pumpen K.H. Brinkmann GmbH & Co. KG, Werdohl (DE)

(72) Inventor: Markus Helpertz, Dortmund (DE)

(73) Assignee: Brinkmann Pumpen K.H. Brinkmann GmbH & Co. KG, Werdohl (DE)

( * ) Notice: Subject to any disclaimer, the term of this patent is extended or adjusted under 35 U.S.C. 154(b) by 97 days.

(21) Appl. No.: 18/031,466

(22) PCT Filed: Sep. 29, 2021

(86) PCT No.: PCT/EP2021/076788
§ 371 (c)(1),
(2) Date: Apr. 12, 2023

(87) PCT Pub. No.: WO2022/078758
PCT Pub. Date: Apr. 21, 2022

(65) Prior Publication Data

US 2023/0374987 A1 Nov. 23, 2023

(30) Foreign Application Priority Data

Oct. 16, 2020 (DE) ..... 102020127285.5

(51) Int. Cl.
*F04C 14/28* (2006.01)
*F04B 49/06* (2006.01)
(Continued)

(52) U.S. Cl.
CPC ..... *F04B 49/065* (2013.01); *F04B 49/20* (2013.01); *F04C 2/16* (2013.01); *F04C 14/28* (2013.01); *F04C 2270/18* (2013.01)

(58) Field of Classification Search
CPC ..... F04B 49/06; F04B 49/065; F04B 49/20; F04C 2/16; F04C 14/28; F04C 2270/18
See application file for complete search history.

(56) References Cited

U.S. PATENT DOCUMENTS 4,487,058 A * 12/1984 Mennenga ..... G01M 3/226 73/40
7,228,726 B2 * 6/2007 Kates ..... G01M 3/2815 73/40

(Continued)

FOREIGN PATENT DOCUMENTS

DE 60221358 T2 5/2008
DE 102014104708 B3 5/2015

(Continued)

OTHER PUBLICATIONS

DE102015206403MT, Machine Translation of DE102015206403 (Year: 2016).*

*Primary Examiner* — Wesley G Harris
*Assistant Examiner* — Charles W Nichols
(74) *Attorney, Agent, or Firm* — Richard M. Goldberg

(57) ABSTRACT

A method of detecting leakage in a pump (10) that has at least one displacement body (12) for displacing a medium to be pumped into a pressure line (20), the method including the steps of: a) closing-off the pressure line (20), b) operating the pump (10) with a known speed of the displacement body (12), c) measuring the pressure (P) in the pressure line (20), d) repeating the steps b) and c) with different speeds, and e) recording the dependency of the measured pressure from the speed, wherein the speed of the displacement body (12) is program-controlled to increase, starting from a minimum speed, gradually to a maximum speed, the maximum speed being calculated on the basis of the measured pressure rise.

7 Claims, 2 Drawing Sheets

(51) Int. Cl.
*F04B 49/20* (2006.01)
*F04C 2/16* (2006.01)

(56) References Cited

U.S. PATENT DOCUMENTS

| | | | | |
|---|---|---|---|---|
| 2005/0147508 | A1 | 7/2005 | Luongo et al. | |
| 2009/0208346 | A1* | 8/2009 | McLoughlin | F04D 15/0066 417/34 |
| 2017/0350303 | A1* | 12/2017 | Duan | F01P 7/165 |
| 2018/0100496 | A1 | 4/2018 | Zhang et al. | |
| 2022/0049697 | A1* | 2/2022 | Pawellek | F04C 2/16 |

FOREIGN PATENT DOCUMENTS

| | | | |
|---|---|---|---|
| DE | 102015206403 | A1 * | 10/2016 |
| EP | 0114646 | B1 | 9/1988 |
| EP | 0264148 | B1 | 4/1991 |
| WO | 2020048947 | A1 | 3/2020 |

* cited by examiner

METHOD FOR ASCERTAINING LEAKS OF A DISPLACEMENT PUMP

BACKGROUND OF THE INVENTION

The invention relates to a method for detecting leakage in a pump that has at least one displacement body for displacing a medium to be pumped into a pressure line, the method comprising the steps of:

a) closing-off the pressure line,
b) operating the pump with a known speed of the displacement body,
c) measuring the pressure in the pressure line
d) repeating the steps b) and c) with different speeds, and
e) recording the dependency of the measured pressure on the speed.

Examples for positive displacement pumps to which the invention is applicable comprise piston pumps, gear pumps, rotary piston pumps and screw spindle pumps.

In a piston pump, the displacement body is formed by the piston which is arranged to be movable in a cylinder and delimits, together with the walls of the cylinder, a pump volume that is in communication with the pressure line. When the piston moves in a sense of reducing the pump volume, the medium to be pumped is displaced into the pressure line, and a pump action is achieved thereby.

In a screw spindle pump, the displacement bodies are formed by one or more screw spindles that are disposed to be rotatable in a casing and delimit, with one another and/or with the walls of the casing, one or more pump volumes. In the course of the rotation of the screw spindles, the positions where the screw-shaped displacement bodies and the walls of the casing form sealing gaps that enclose the pump volume move axially towards a high pressure side of the pump, so that the medium is displaced into the pressure line.

In such positive displacement pumps, ideally, the volume flow rate is uniquely determined by the geometry of the displacement bodies and the speed thereof (linear velocity in case of a piston, rotary speed in case of a screw spindle pump), so that, when the speed is known, the volume flow rate can be calculated. In practice, it is not possible, however, to totally seal-off the contact points between the displacement bodies and the walls of the casing, so that gaps are formed that are sealed only more or less and at which an internal leakage can occur, i.e., a part of the medium that has been pumped flows back to the low pressure side. Moreover, depending upon the design of the pump, outer leakages may also occur, for example at seals at which a drive member for the displacement body or bodies enters into the casing. For these reasons, the actual volume flow rate of the pump is in practice smaller than the value that should be expected theoretically. The quotient between these two quantities is designated as volumetric efficiency and should in general be within certain tolerance limits. However, the gap dimensions may become larger during operation of the pump due to wear, so that leakages may increase in the course of time and, accordingly, the volumetric efficiency decreases.

In many applications it is therefore necessary to check the wear condition of the pump from time to time by measuring the difference between the theoretical volume flow rate and the actual volume flow rate. However, a precise measurement of the actual volume flow rate is relatively cumbersome and requires the use of expensive volume flow meters.

WO 2020/048,947 A1 discloses a method of the type indicated above, with which it is possible to characterize the type and nature of a detected leakage more precisely on the basis of the recorded dependency of the pressure from the speed.

SUMMARY OF THE INVENTION

It is an object of the invention to provide a method by which the wear condition of a positive displacement pump can be determined automatically and with a minimized risk of causing damage to the pump.

In order to achieve this object, in the method according to the invention, the speed of the displacement body is program-controlled to increase, starting from a minimum speed, gradually to a maximum speed, said maximum speed being calculated on the basis of the measured pressure rise.

The invention is based on the consideration that, when the pump is operated under a condition in which the pressure line is closed-off, the risk of causing damage to the pump, due to vibrations or heating, for example, increases significantly when the speed of the displacement body exceeds a certain limit that is dependent upon the wear condition of the pump. In general, in order to obtain a meaningful pressure/speed-curve, the speed should be increased so far that the pressure rises to a value that is as high as possible but still not harmful to the pump. The larger the wear and the leakage of the pump are, the higher is the speed at which this pressure value is reached. In a pump that has a high leakage, the limit for a damage-free operation of the pump may be exceeded. However, since the wear condition of the pump is not yet known at the beginning of the measurement, it is not possible to determine this limit in advance.

The invention solves this problem by starting at a safe minimum speed and then increasing the speed gradually in the course of the pressure measurement. The slower the pressure rises as a function of the speed, the larger is the leakage of the pump. It is therefore possible to infer the wear condition of the pump on the basis of the pressure rise and then to use the wear condition that has been determined in this way for determining the limit to which the speed can be increased.

This method can be executed automatically by means of an electronic controller that has been programmed suitably, so that meaningful measurement curves can be obtained without any need for the personnel to monitor the condition and behavior of the pump or to employ temperature sensors, vibration sensors or other sensors for that purpose.

Useful details and further developments of the invention are indicated in the dependent claims.

The pressure sensor and the lock valve may remain in the pressure line during normal operation of the pump, so that the wear condition of the pump can be checked at any time with only little effort. For example, a check of the wear condition may be triggered automatically when a signal from a consumer that is connected to the pump indicates that the consumer is presently not in need for the pressurized medium.

In the course of the measurement process, the speed of the displacement body (i.e. the rotary speed of the pump motor) may be increased continuously or step-wise. The measured pressure may be recorded not only as a function of the speed but also as a function of the time, so that periodic pressure pulsations may be detected in the measured pressure signal. These pressure pulsations may be utilised on the one hand for measuring or checking the rotary speed and may on the other hand provide more specific information on the wear condition of the pump. For example, the speed of the pump may be kept constant at each speed level for at least the duration of a full operating cycle of the pump, and the pressure pulsations that have been recorded during this time may be converted, by fast Fourier transformation (FFT), into a spectrum that may then be analysed for obtaining further insight into the nature of the leakage. Likewise, any possible air bubbles in the medium may be detected by analysing the pressure pulsations.

BRIEF DESCRIPTION OF THE DRAWINGS

An embodiment example will now be described in conjunction with the drawings, wherein.

DETAILED DESCRIPTION

Figure 1:
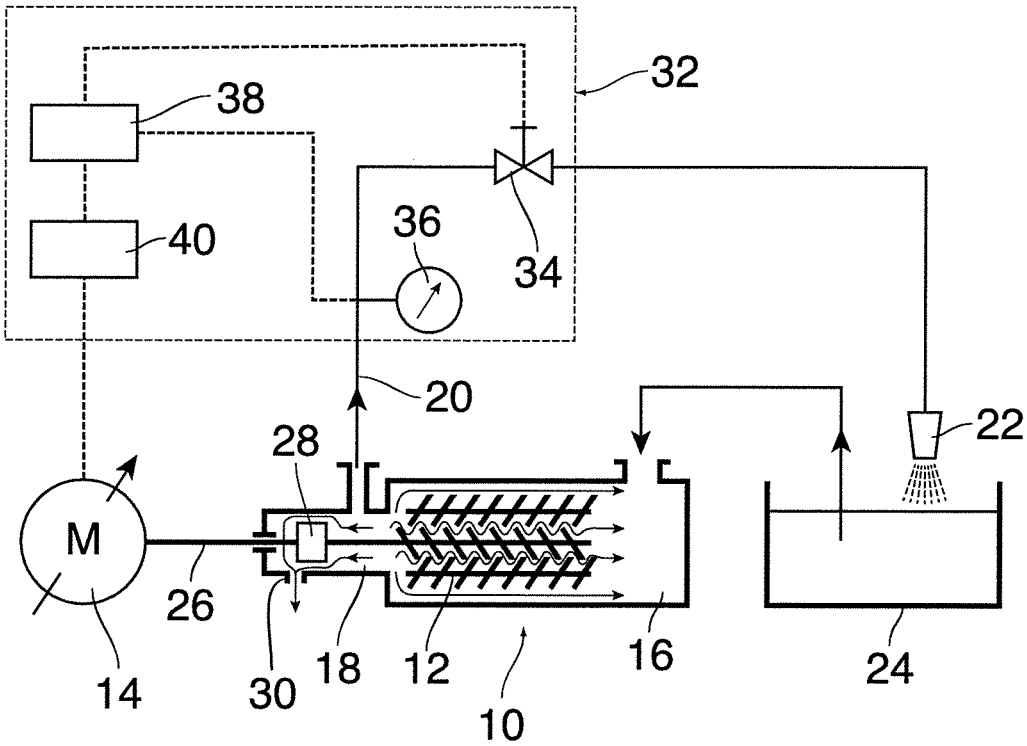
FIG. 1 is a sketch of a positive displacement pump having a system for detecting leakages by means of a method according to the invention.

As an example of a positive displacement pump, FIG. 1 shows a screw spindle pump 10 having displacement bodies 12 in the form of screw spindles. The screw spindles are in sealing engagement with one another and with the walls of the pump casing and are driven by a motor 14 with equal rotary speeds, so that the volume spaces that are delimited by the screw spindles move axially from a low pressure side 16 of the pump towards a high pressure side 18, and a medium, e.g. a liquid, that is taken in at the low pressure side is displaced towards the high pressure side 18. The high pressure side of the pump is connected to a pressure line 20 through which the medium is supplied under high pressure to a consumer 22 (a spray nozzle in the example shown). The medium that has been discharged by the consumer is collected in a collection vessel 24 that is connected to the low pressure side of the pump, so that the medium may be recirculated.

The motor 14 is connected via a shaft 26 to a gear box, which has not been shown in detail, for driving the screw spindles, the shaft entering into the pump casing on the high pressure side 18. In order to reduce the pressure at the point where the shaft 26 penetrates the casing wall, a throttle 28 is provided in the casing of the pump 10 between the connection point of the pressure line 20 and the feedthrough for the shaft 26, the throttle having the function to reduce the pressure and to permit only a limited leakage flow which will exit from the casing through a leakage opening 30. Moreover, an internal leakage flow occurs inside of the pump 10 because a part of the medium that has been pumped flows back from the high pressure side 18 to the low pressure side 16 via gaps between the displacement bodies 12 and the casing.

A measurement kit 32 is provided for measuring the total amount of the several internal and external leakage flows of the pump and thereby to check whether the leakage is still within an admissible range. The measurement kit 32 comprises a lock valve 34 by which the pressure line 20 can be closed-off completely, a pressure sensor 36 connected to the pressure line 20 upstream of the lock valve 34 for measuring the pressure in the pressure line, and an electronic control and evaluation device 38 which controls the rotary speed of the motor 14 via a frequency converter 40 and processes a pressure signal that is provided by the pressure sensor 36. In the example shown, the control and evaluation device 38 is further connected to the lock valve 34 via a control line, so that the valve can be actuated electronically.

During normal operation of the pump 10, the lock valve 34 is open, and the rotary speed of the motor 14 is controlled or feedback-controlled such that the demand of the consumer 22 can be met.

Operational phases in which the consumer 22 is not active may be utilized for checking the wear condition of the pump 10 by means of the measurement kit 32. To that end, the lock valve 34 is closed and the motor 14 is driven with a rotary speed that may be smaller than the speed in normal operation. Then, a pressure that is detected by the pressure sensor builds up in the upstream part of the pressure line 20. The more this pressure increases, the larger becomes the pressure drop at the leakage points of the pump, and the leakage volume flow rate at all these leakage points increases as well, the increase being approximately in proportion to the pressure drop, in case of laminar flow of a (Newtonian) liquid with constant viscosity, and generally in proportion to the square of the pressure drop in case of a turbulent flow. The pressure measured by the pressure sensor 36 increases until an equilibrium has been reached between the leakage volume flow rate and the displacement volume flow rate of the pump 10. While the motor 14 is driven with unchanged rotary speed, the pressure sensor 36 will therefore measure, after a certain time, a constant pressure level which is indicative of the flow resistance of the leakage points. The larger the pressure level that is being reached, the larger is the leakage flow resistance.

In the equilibrium state, the leakage volume flow rate may be calculated on the basis of the rotary speed of the motor 14 because the leakage volume flow rate is equal to the theoretical displacement volume flow rate of the pump 10 that can be calculated for the given rotary speed on the basis of the known geometry of the pump 10.

On the basis of the known relation between the calculated leakage volume flow rate and the pressure P measured by the pressure sensor 36, the flow resistance that opposes the leakage flow may be calculated. From this flow resistance, the leakage flow can also be calculated for the normal operating phases of the pump 10, i.e. the phases in which the motor driven is driven with a rotary speed as required by the consumer 22. From the leakage volume flow rate that is obtained in this way and from the theoretical displacement volume flow rate for the given rotary speed, the volumetric efficiency of the pump can be calculated, and it can be assessed how much this efficiency has decreased due to wear of the pump.

The measurement process described above is then repeated for different rotary speeds n of the motor 14. For example, starting with a minimum speed n1, the rotary speed is increased step-wise with uniform or non-uniform increments, and in each step the pressure P is recorded as a function of the rotary speed after the pressure P has stabilized.

Figure 2:
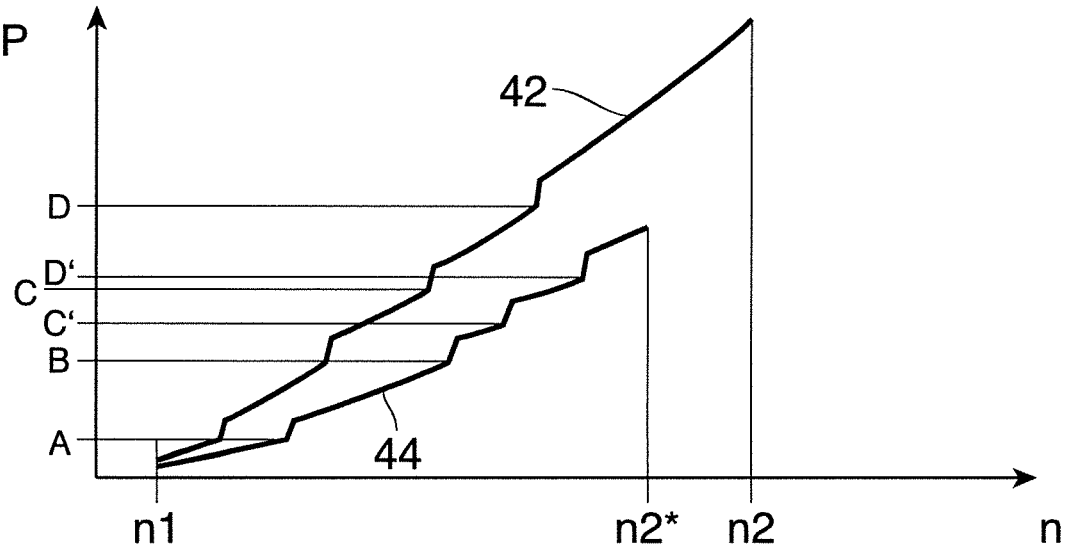
FIG. 2 shows examples of typical relations between a rotary speed of a drive motor of the pump and the pressure in the pressure line for pumps under different wear conditions.

As an example, FIG. 2 shows two curves 42, 44 which respectively indicate the dependency of the pressure P from the rotary speed n. In this example, the speed increments have been selected to be so small that the curves are practically continuous. The curve 42 represents results that would be expected for a brand-new screw spindle pump 10 of the type shown in FIG. 1. The relatively steep rise of this curve shows that the leakage volume is relatively small and within a normal range. In contrast, the curve 44 represents a pump of the same type in which a significant wear has occurred already, so that the leakage flow is larger and the rise of the curve is more flat, accordingly.

As would be expected for a Newtonian liquid, the curves 42 and 44 are approximately linear at small speeds. However, at certain pressure levels A, B, . . . , they have discontinuities at which the pressure increases abruptly. These discontinuities represent, each for a respective leakage gap of the pump, a transition from laminar flow to turbulent flow of the leakage at this gap. The rotary speed at which the transition takes place depends among others on the width of the gap and the roughness of the surface as well as the pressure difference between the volumes that are separated by the gap. Each of these discontinuities represents a certain type of gap, e. g. a profile-matching gap between a main spindle and a side spindle of the pump or a casing gap between the casing of the pump and the main spindle or the casing and one of the side spindles.

If the curves 42 and 44 are compared to one another, it can be seen that the two first discontinuities of both curves occur at approximately the same pressure, namely at the pressure A for the first discontinuity and the pressure B for the second discontinuity. This indicates that the width of the gap is approximately equal for the corresponding gap types, i.e. no significant wear has occurred at these two gaps even in the older pump. In contrast, the discontinuities that occur at higher speeds appear at the pressures C and D in case of the curve 42 whereas they are shifted to lower pressures C' and D' in case of the curve 44. This shows that the corresponding gaps have changed due to wear.

In this way, the reason for the leakage flow may be localised more closely by analysing the curve 44.

In the example shown, the speed of the brand-new pump (curve 42) has been increased by and by to a maximum value n2. Since the leakage flow of this pump is small, a correspondingly high maximum pressure has been reached. If one wanted to reach the same maximum pressure also for the pump that has been subject to wear (curve 44), the speed would have to be increased substantially beyond n2, due to the flat increase of this curve. This would incur the risk that the pump or the pump motor is over-heated or the pump is damaged by increasingly stronger vibrations. In general, the susceptibility of a pump for such vibrations increases with increasing leakage, so that for a pump that has already suffered from a certain wear, the maximum speed should be limited in order to avoid further damage to the pump. For this reason, in the automated measurement process that is being proposed here, the leakage flow is calculated and the wear condition of the pump is evaluated on the basis of the steepness of the curves 42 and 44, respectively, already in the first phase of the measurement process right above the minimum speed n1. When, then, the wear condition of the pump has become known at least approximately, the maximum speed is determined on the basis of this wear condition. In the example shown, this had the effect, that, for the pump represented by the curve 44, the measurement process has already been aborted at a lower rotary speed n2* in order to avoid damage to the pump.

For a pump with a given design, the relation between the measured leakage flow and the maximum rotary speed n2 or n2* that should not been exceeded in the measurement process can be calculated on the basis of theoretical models or can be determined experimentally by means of test samples. Once this relation is known for a given design, the control and evaluation device 38 is programmed such that the rotary speed is increased only up to the corresponding maximum speed.

Likewise is it possible for a pump of a given design to determine by theoretically calculations or experimental tests where the discontinuities should be located for a pump that has not been subject to wear, in other words, which gap belongs to which discontinuity. With this knowledge, it is then possible to utilize the measurement sequences that have been recorded automatically for a precise diagnosis of the pump.

Figure 3:
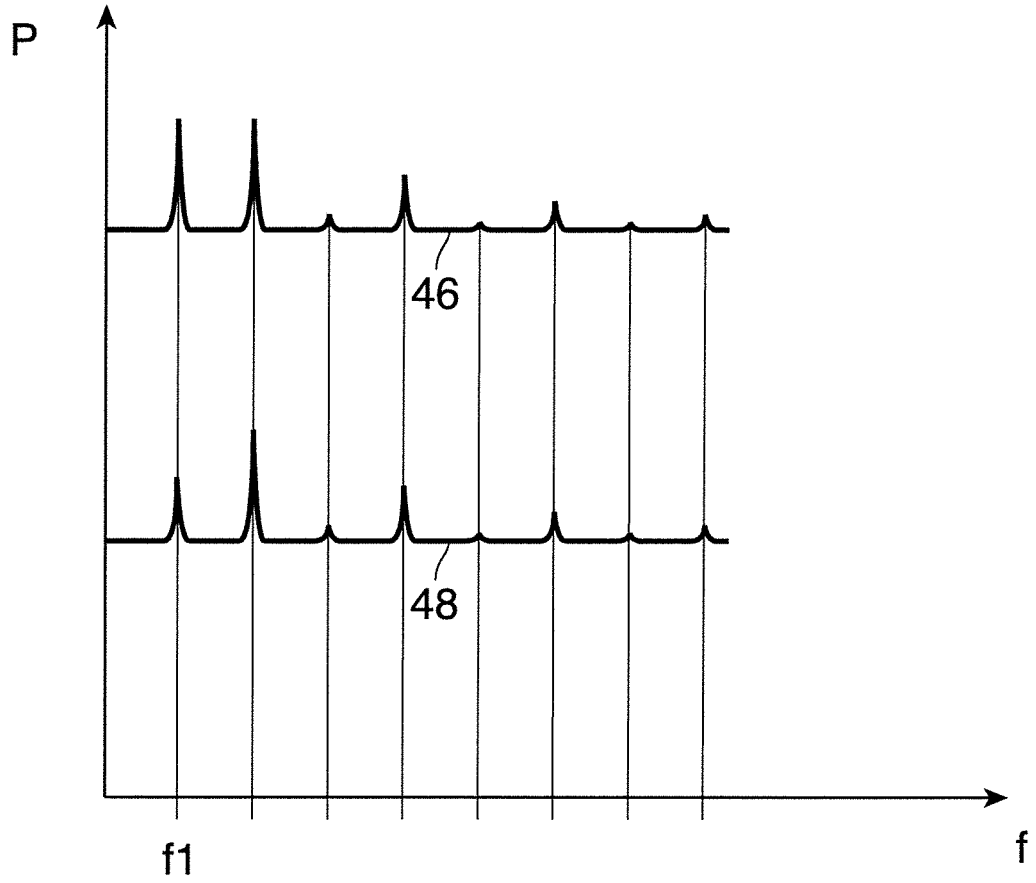
FIG. 3 shows an example of spectra of pressure pulsations under different wear conditions.

Moreover, in the method proposed here, the measured pressure P is also recorded as a function of time and converted into a corresponding spectrum by fast Fourier transformation in which the speed of the pump is kept constant. FIG. 3 shows examples of two spectra that have been obtained for different pumps. The curve 46 shows a spectrum of a brand-new pump, and the curve 48 shows a spectrum of a pump that has already suffered from substantial wear. The curves show periodic pressure pulsations with a basic frequency f1, that corresponds to the rotary speed of the screw spindles, and with higher harmonics. In case of the curve 48 the higher wear of the pump can be inferred in particular from the fact that the amplitude of the basis frequency f1 is significantly smaller than in case of the curve 46.

Eventually, the detection of the pressure pulsations offers also an elegant way to measure the rotation period T and therewith the rotary speed of the pump. For example it can be checked in this way whether the speed of the pump has actually had the value that was required by the program. In principle, a feedback-control of the rotary speed of the pump would also be possible, but a direct feedforward control of the rotary speed is preferred because speed control in a closed feedback loop may cause oscillations that could compromise the measurement results or extend the duration of the measurement.

The control and evaluation device 38 may also be programmed such that the leakage measurement is performed automatically in certain time intervals, wherein the exact timing of the measurement may be dependent upon the demand of the consumer 32. The measurement results may be recorded automatically, printed and/or transmitted via a wireless link to a smartphone of an operator. Likewise, an alarm may be triggered automatically in cases in which the volumetric efficiency has become unacceptably low.

What is claimed is:

1. A method of detecting leakage in a pump that has at least one displacement body for displacing a medium to be pumped into a pressure line, the method comprising the steps of:

a) closing-off the pressure line, b) operating the pump with a known speed of the displacement body, c) measuring the pressure in the pressure line, d) repeating the steps b) and c) with different speeds, e) recording the dependency of the measured pressure from the speed for the different speeds, f) determining a maximum speed of the at least one displacement body, before failure of the pump occurs, from the recorded dependencies of the measured pressure from the speed for the different speeds, prior to reaching said maximum speed, and g) program-controlling a speed of the displacement body to increase, starting from a minimum speed, gradually to a speed less than the maximum speed to prevent failure of the pump.

2. The method according to claim 1, further comprising the step of detecting an operating condition of a consumer to which the medium is supplied by the pump, and wherein said step of closing-off the pressure line includes the step of closing-off the pressure line in order to initiate a measurement process at a time when the consumer does not need to be supplied with the medium.

3. The method according to claim 1, wherein the pump is a screw spindle pump.

4. The method according to claim 1, further including the step of providing the speed of the displacement body by one of:

a rotary speed of a drive member for the displacement body or the displacement body itself.

5. The method according to claim 4, further including the step of increasing the speed step-wise.

6. The method according to claim 4, further including the step of recording the measured pressure as a function of time.

7. The method according to claim 6, further including the step of keeping the speed constant in each step for at least the duration of a full operation cycle of the displacement body.

* * * * *